US011145962B2

(12) United States Patent
Kotzer et al.

(10) Patent No.: US 11,145,962 B2
(45) Date of Patent: Oct. 12, 2021

(54) CONFORMAL ANTENNAS FORMED AT A SURFACE OF A VEHICLE

(71) Applicant: GM Global Technology Operations LLC, Detroit, MI (US)

(72) Inventors: Igal Kotzer, Tel-Aviv (IL); Ofer Givati, Herzliya (IL)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/810,011

(22) Filed: Mar. 5, 2020

(65) Prior Publication Data

US 2021/0280963 A1 Sep. 9, 2021

(51) Int. Cl.
*H01Q 1/32* (2006.01)
*H01Q 1/12* (2006.01)

(52) U.S. Cl.
CPC ..... *H01Q 1/3275* (2013.01); *H01Q 1/12* (2013.01)

(58) Field of Classification Search
CPC ..... H01Q 1/12; H01Q 1/3275; H01Q 9/0442; H01Q 21/065
USPC ..... 343/713
See application file for complete search history.

(56) References Cited

U.S. PATENT DOCUMENTS 5,905,471 A * 5/1999 Biebl ..... H01Q 13/10 343/769
6,768,471 B2 * 7/2004 Bostwick ..... H01Q 1/286 343/776
10,193,584 B2 * 1/2019 Ying ..... H01Q 1/273
2003/0122721 A1 * 7/2003 Sievenpiper ..... H01Q 9/14 343/767
2003/0174095 A1 * 9/2003 Sievenpiper ..... H01Q 13/10 343/770
2005/0156786 A1 * 7/2005 Blaschke ..... H01Q 1/286 343/700 MS
2005/0195116 A1 * 9/2005 Lotterer ..... H01Q 13/10 343/713
2007/0171127 A1 * 7/2007 Mizugaki ..... H01Q 21/064 343/700 MS
2011/0273351 A1 * 11/2011 Johnson ..... H01P 5/10 343/770
2013/0306390 A1 * 11/2013 Elson ..... B60R 25/04 180/167
2017/0005403 A1 * 1/2017 Lam ..... H01Q 1/286
2018/0013210 A1 * 1/2018 Rosenkrantz ..... H01Q 3/267
2019/0348754 A1 * 11/2019 Apostolos ..... H01Q 9/0442
2020/0099123 A1 * 3/2020 Rogers ..... H01Q 3/44
2020/0099127 A1 * 3/2020 Rogers ..... H01Q 1/287

* cited by examiner

*Primary Examiner* — Lam T Mai
(74) *Attorney, Agent, or Firm* — Cantor Colburn LLP

(57) ABSTRACT

A conformal antenna at a surface of a vehicle and a method of forming the conformal antenna involve a slot formed in a portion of the surface of the vehicle. The method includes disposing the antenna in the slot. An exposed surface of the antenna is level with the surface of the vehicle. The method also includes connecting the antenna to one or more systems of the vehicle such that the antenna transmits or receives signals processed by the one or more systems.

18 Claims, 4 Drawing Sheets

CONFORMAL ANTENNAS FORMED AT A SURFACE OF A VEHICLE

INTRODUCTION

The subject disclosure relates to conformal antennas formed at a surface of a vehicle.

Vehicles (e.g., automobiles, trucks, construction equipment, farm equipment, automated factory equipment) include an increasing number of communication devices and corresponding antennas. For example, vehicles include a receiver and corresponding antenna to receive data from a global navigation satellite system (GNSS) such as the global positioning system (GPS). They also include receivers and antennas to receive radio and satellite radio channels. In addition, vehicles communicate with other vehicles in vehicle-to-vehicle (V2V) communication, with infrastructure in vehicle-to-infrastructure (V2I) communication, and with other entities (e.g., cloud servers) in vehicle-to-everything (V2X) communication using different antennas. Antennas protruding external to a vehicle are aesthetically displeasing. Thus, a prior approach has included concealed antennas that are hidden behind glass or another dielectric (i.e., non-conducting) part of the vehicle. Accordingly, it is desirable to provide conformal antennas formed at a surface of a vehicle.

SUMMARY

In one exemplary embodiment, a method of forming a conformal antenna at a surface of a vehicle includes forming a slot in a portion of the surface of the vehicle, and disposing the antenna in the slot. An exposed surface of the antenna is level with the surface of the vehicle. The method also includes connecting the antenna to one or more systems of the vehicle such that the antenna transmits or receives signals processed by the one or more systems.

In addition to one or more of the features described herein, the forming the slot includes specifying dimensions of the slot based on dimensions of the antenna.

In addition to one or more of the features described herein, the method also includes filling the slot with a filler material after the disposing the antenna in the slot.

In addition to one or more of the features described herein, the filling the slot includes using a resin as the filler material.

In addition to one or more of the features described herein, the disposing the antenna in the slot includes placing a single or multi-layer printed circuit board (PCB) in the slot.

In addition to one or more of the features described herein, the disposing the antenna also includes arranging a radiating element as the exposed surface that is level with the surface of the vehicle.

In addition to one or more of the features described herein, the disposing the antenna also includes arranging metal conductors to connect the radiating element to the PCB.

In addition to one or more of the features described herein, the disposing the antenna also includes disposing electronic components.

In addition to one or more of the features described herein, the disposing the electronic components includes disposing a radio frequency (RF) front end, RF beam formers, RF up and down converters, a modem chip, analog filters, or power supply circuitry.

In addition to one or more of the features described herein, the disposing the antenna in the slot includes disposing a bowtie dipole antenna, a patch antenna, or a spiral antenna.

In another exemplary embodiment, a vehicle with a conformal antenna at a surface of the vehicle includes a slot in a portion of the surface of the vehicle, and the antenna disposed in the slot. An exposed surface of the antenna is level with the surface of the vehicle. One or more systems of the vehicle connected to the antenna such that the antenna transmits or receives signals processed by the one or more systems.

In addition to one or more of the features described herein, the dimensions of the slot are based on dimensions of the antenna.

In addition to one or more of the features described herein, the slot is filled with a filler material after the antenna is disposed in the slot.

In addition to one or more of the features described herein, the filler material is a resin.

In addition to one or more of the features described herein, the antenna in the slot includes a single or multi-layer printed circuit board (PCB).

In addition to one or more of the features described herein, the antenna also includes a radiating element as the exposed surface that is level with the surface of the vehicle.

In addition to one or more of the features described herein, the antenna also includes metal conductors that connect the radiating element to the PCB.

In addition to one or more of the features described herein, the antenna also includes electronic components.

In addition to one or more of the features described herein, the electronic components include a radio frequency (RF) front end, RF beam formers, RF up and down converters, a modem chip, analog filters, or power supply circuitry.

In addition to one or more of the features described herein, the antenna is a bowtie dipole antenna, a patch antenna, or a spiral antenna.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
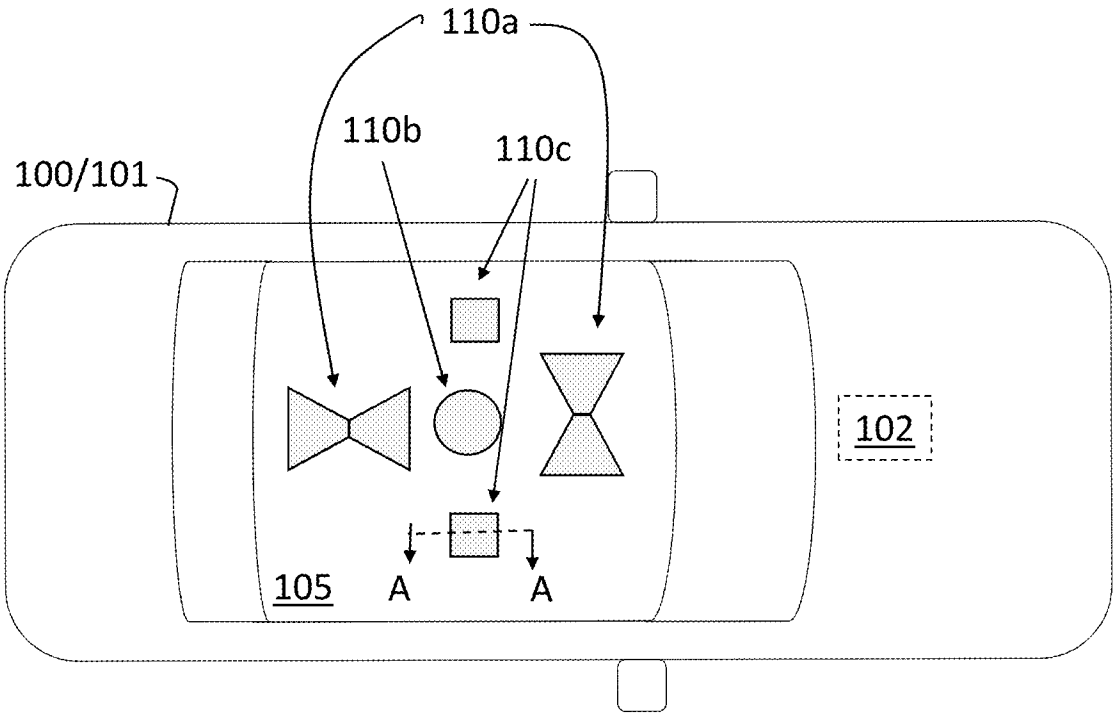
FIG. 1 shows conformal antennas at a surface of a vehicle according to one or more embodiments.

The following description is merely exemplary in nature and is not intended to limit the present disclosure, its application or uses. It should be understood that throughout the drawings, corresponding reference numerals indicate like or corresponding parts and features.

As previously noted, vehicles have an increasing need for antennas of different kinds. Protruding antennas, while practical, are not aesthetically desirable. Prior vehicle antennas have been hidden behind dielectric parts such as glass. These antennas may be conformal with the shape of the vehicle depending on where they are positioned. However, the dielectric material covering the concealed antennas may interfere with the propagation of electromagnetic (EM) waves. Embodiments of the systems and methods detailed herein relate to conformal antennas formed at a surface of a vehicle. The metal skin of the vehicle is slotted, and an antenna is formed by way of slotting. The antenna conforms to the shape of vehicle at the slotted area, yet the antenna is external to the vehicle and, thus, does not suffer from adverse effects due to the internal structure of the vehicle on illumination. For example, multiple lobes may be created in the radiation pattern emitted by the antenna. According to one or more embodiments, the radiating elements of the antenna are at (i.e., level with) the vehicle surface. Thus, the antenna is unobstructed by the internal structure of the vehicle while not protruding above the vehicle.

In accordance with an exemplary embodiment, FIG. 1 shows conformal antennas 110 at a surface of a vehicle 100. The exemplary vehicle 100 shown in FIG. 1 is an automobile 101. The exemplary antennas shown in FIG. 1 include bowtie dipole antennas 110*a*, a spiral antenna 110*b*, and patch antennas 110*c* (all generally referred to as 110). The discussion with reference to FIG. 2 details aspects of the fabrication of the antennas 110 on the vehicle 100 according to one or more embodiments. All of the antennas 110 may be used for different sensor or communication systems 102 of the vehicle 100. A given antenna 110 may be used to transmit, receive, or both. Alternately, one or more of the antennas 110 may be shared by different systems 102.

For example, both the bowtie dipole antennas 110*a* may be shared for use with cellular and satellite radio receiver systems. The orientation of the two bowtie dipole antennas 110*a* being perpendicular to each other facilitates obtaining different radiation patterns. The different radiation patterns result in diversity gain. A cellular receiver may select one of the bowtie dipole antennas 110*a* according to which one exhibits higher gain based on the relative orientation of the cellular base station and the two bowtie dipole antennas 110. The spiral antenna 110*b* may be used with a global navigation satellite system (GNSS) (e.g., global positioning system (GPS)), as well as for WiFi. The patch antennas 110*c* may both be used for vehicle-to-vehicle (V2V) communication. Antennas 110 formed according to one or more embodiments may also be used for millimeter wave (mmWave) communication (i.e., communication at frequencies corresponding with wavelengths on the order of millimeters) which is allocated for a fifth generation (5G) cellular network, for example.

The types of exemplary antennas 110 and the above-noted examples of systems 102 are not intended to be limiting. In addition, the arrangement of the antennas 110 and their orientation relative to each other is also not limited by the exemplary illustration. Further, while all the exemplary antennas 110 in FIG. 1 are shown to be placed along the roof line of the vehicle 100, one or more antennas 110 that are fabricated according to exemplary embodiments may be disposed on other parts of the vehicle 100. While the antennas 110 are shown as appearing distinct from the vehicle 100 for explanatory purposes, the antennas 110 may be concealed by painting the antennas 110 the same color as the vehicle 100, for example. The cross-section A-A indicated in FIG. 1 is detailed in FIG. 2.

Figure 2:
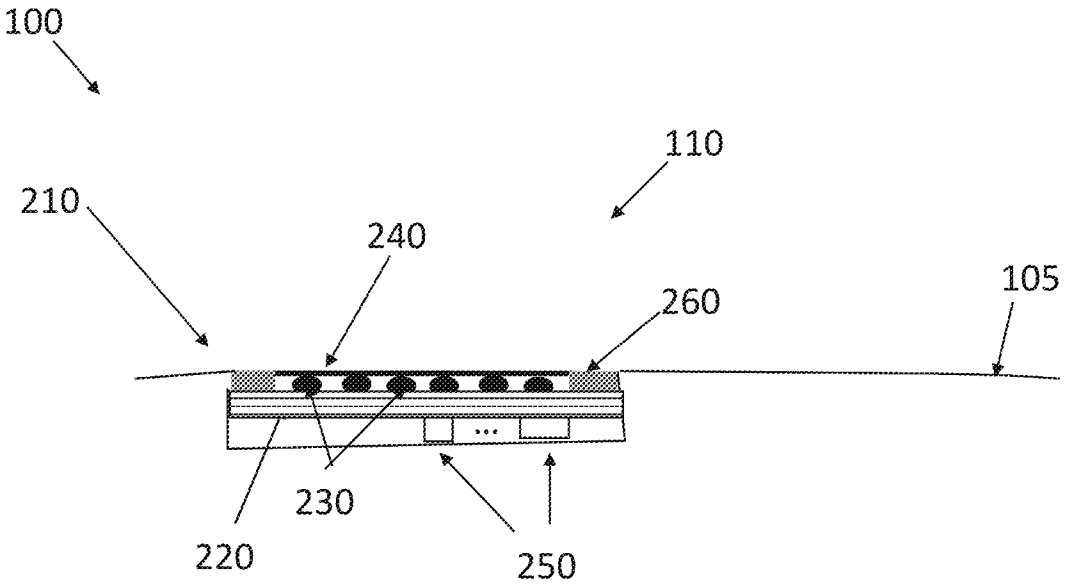
FIG. 2 is a cross-sectional view of an antenna formed at a surface of a vehicle according to one or more embodiments.

FIG. 2 is a cross-sectional view of an antenna 110 formed at a surface of a vehicle 100 according to one or more embodiments. The cross-sectional view is taken along A-A shown in FIG. 1. Thus, the exemplary surface of the vehicle 100 is the roof 105. The cross-sectional view shows the slot 210 that is formed by cutting a portion of the roof 105 or in another way. Dielectric material such as a single multi-layer printed circuit board (PCB) 220 is shown in the slot 210. Metal conductors 230 facilitate a galvanic connection between the PCB 220 and a radiating element 240 of the antenna 110.

In addition, electronic components 250 may be disposed on a side of the PCB 220 that is opposite the side that connects with the radiating element 240 (i.e., a bottom side of the PCB 220 based on the perspective shown in FIG. 2), as shown. Alternately, some or all of the electronic components 250 may be disposed in the gaps between the metal conductors 230, for example. Exemplary components include, but are not limited to, radio frequency (RF) components such as the RF front end, RF beam formers, RF up and down converters, a modem chip, analog filters, and power supply circuitry. Filler material 260 is indicated and is further discussed with reference to FIG. 3. As the cross-sectional view in FIG. 2 indicates, the radiating element 240 is flush with the surface line of the roof 105 of the vehicle 100. Thus, the antenna 110 does not protrude from the surface of the vehicle 100. At the same time, because the antenna 110 is disposed in the slot 210, the radiating element 240 is exposed to free-space and, thus, received or transmitted signals do not suffer any impairments (e.g., attenuation, multipath) due to passage through a medium other than free-space to and from the antenna 110.

Figure 3:
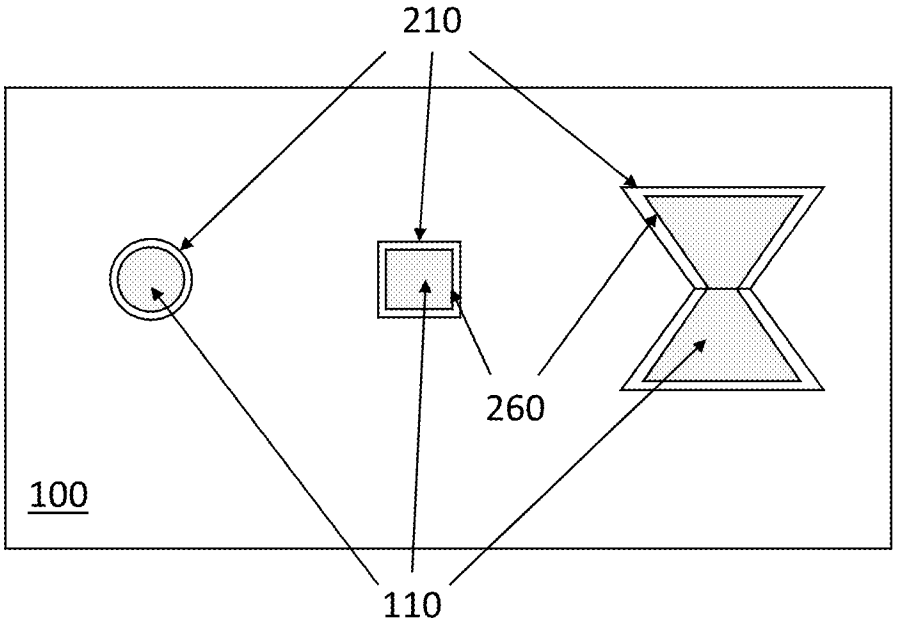
FIG. 3 details aspects of antennas formed at a surface of a vehicle according to one or more exemplary embodiments.

FIG. 3 details aspects of antennas 110 formed at a surface of a vehicle 100 according to one or more exemplary embodiments. While antennas 110 are shown formed at the surface of the roof 105 in FIGS. 1 and 2, other surfaces of the vehicle 100 may be slotted, as well, as previously noted. Three exemplary antennas 110 are shown formed in slots 210 in FIG. 3. FIG. 2 details the components below the surface. FIG. 3 shows that areas of the slots 210 that are not filled to the surface are filled with filler material 260. The filler material 260 may be a resin or other dielectric material.

Figure 4:
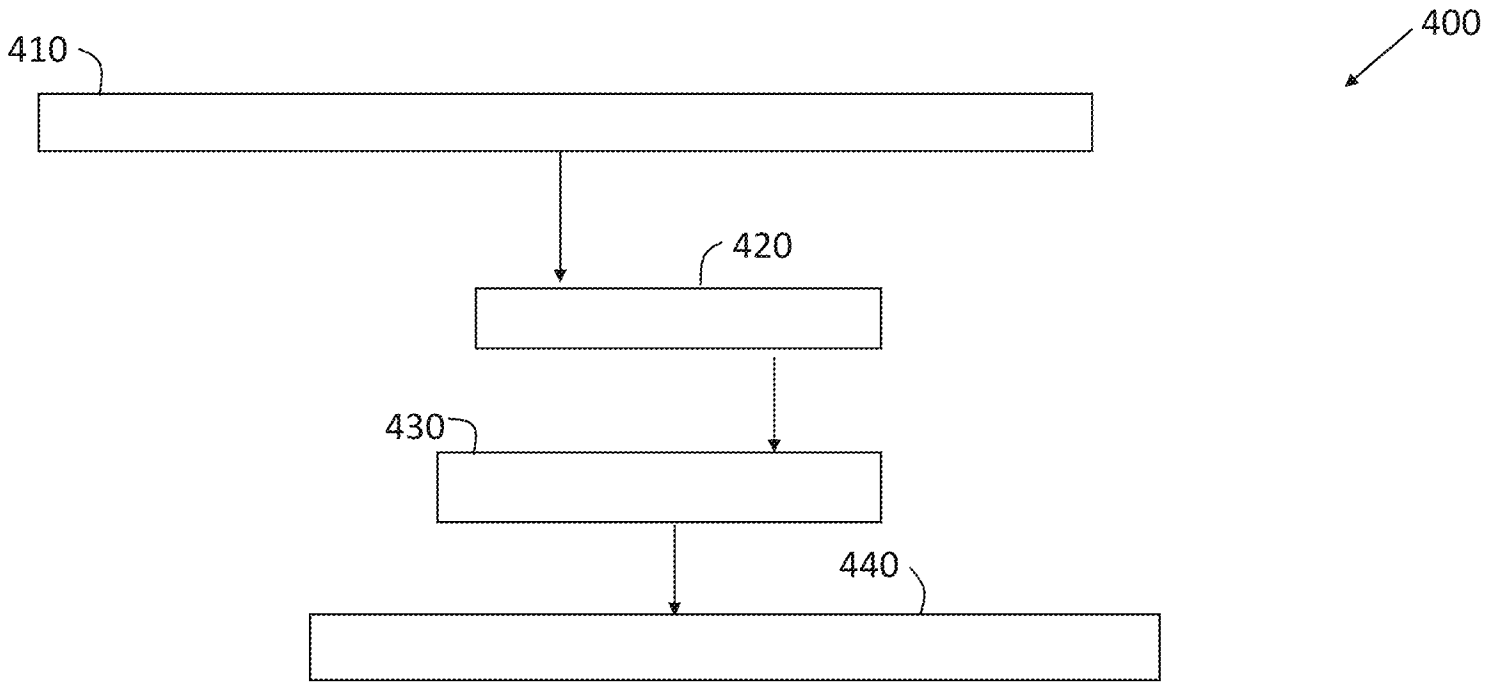
FIG. 4 is a process flow of a method of forming a conformal antenna at a surface of a vehicle according to one or more embodiments.

FIG. 4 is a process flow of a method 400 of forming a conformal antenna 110 at a surface of a vehicle 100 according to one or more embodiments. Continuing reference is made to FIGS. 1-3. At block 410, the processes include forming a slot 210 of specific dimensions in a portion of the surface of a vehicle 100. The slot 210 in the surface of the vehicle 100 will have a length and width that accommodates the radiating element 240 with some additional space to facilitate insertion of the filler material 260. As previously noted, the entirety of the radiating element 240 must be unobstructed by any portion of the vehicle 100. In addition, material below the surface of the vehicle 100 (e.g., foam, fabric) may be removed to form an area with sufficient depth to accommodate all the components (e.g., PCB 220, metal conductors 230, electronic components 250) of the antenna 110. At block 420, disposing the antenna 110 in the slot 210 includes ensuring that the top surface of the antenna 110 (e.g., the radiating element 240) is level with the surface in which the slot 210 was formed. This ensures that the antenna 110 will not protrude from the surface of the vehicle 100 but will also not be obstructed by the surface of the vehicle 100.

At block 430, filling the slot 210 with filler material 260 after locating the antenna 110 refers to filling the remainder of the slot 210 with a resin or other dielectric material. As part of the process at block 430, the surface of the antenna 110 may be painted to blend with the surface of the vehicle 100 that was slotted to accommodate the antenna 110. At block 440, the processes include connecting the antenna 110 to one or more systems 102 of the vehicle 100. As previously noted, exemplary but non-limiting systems 102 include the radio, satellite radio, GNSS, WiFi, and V2V communication system. For any of the systems 102 to which it is connected, the antenna 110 receives signals that are processed by the system 102. In some cases (e.g., V2V communication), the antenna 110 may transmit signals from the system 102, as well.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A method of forming a conformal antenna at a surface of a vehicle, the method comprising:

forming a slot in a portion of the surface of the vehicle, wherein the forming the slot includes specifying dimensions of the slot based on dimensions of the conformal antenna;

disposing the conformal antenna in the slot, wherein an exposed surface of the conformal antenna is level with the surface of the vehicle; and connecting the conformal antenna to one or more systems of the vehicle such that the conformal antenna transmits or receives signals processed by the one or more systems.

2. The method according to claim 1, further comprising filling the slot with a filler material after the disposing the conformal antenna in the slot.

3. The method according to claim 2, wherein the filling the slot includes using a resin as the filler material.

4. The method according to claim 1, wherein the disposing the conformal antenna in the slot includes placing a single or multi-layer printed circuit board (PCB) in the slot.

5. The method according to claim 4, wherein the disposing the conformal antenna also includes arranging a radiating element as the exposed surface that is level with the surface of the vehicle.

6. The method according to claim 5, wherein the disposing the conformal antenna also includes arranging metal conductors to connect the radiating element to the PCB.

7. The method according to claim 5, wherein the disposing the conformal antenna also includes disposing electronic components.

8. The method according to claim 7, wherein the disposing the electronic components includes disposing a radio frequency (RF) front end, RF beam formers, RF up and down converters, a modem chip, analog filters, or power supply circuitry.

9. The method according to claim 1, wherein the disposing the conformal antenna in the slot includes disposing a bowtie dipole antenna, a patch antenna, or a spiral antenna.

10. A vehicle with a conformal antenna at a surface of the vehicle, the vehicle comprising:

a slot in a portion of the surface of the vehicle, wherein the dimensions of the slot are based on dimensions of the conformal antenna;

the conformal antenna disposed in the slot, wherein an exposed surface of the conformal antenna is level with the surface of the vehicle; and one or more systems of the vehicle connected to the conformal antenna such that the conformal antenna transmits or receives signals processed by the one or more systems.

11. The vehicle according to claim 10, wherein the slot is filled with a filler material after the conformal antenna is disposed in the slot.

12. The vehicle according to claim 11, wherein the filler material is a resin.

13. The vehicle according to claim 10, wherein the conformal antenna in the slot includes a single or multi-layer printed circuit board (PCB).

14. The vehicle according to claim 13, wherein the conformal antenna also includes a radiating element as the exposed surface that is level with the surface of the vehicle.

15. The vehicle according to claim 14, wherein the conformal antenna also includes metal conductors that connect the radiating element to the PCB.

16. The vehicle according to claim 14, wherein the conformal antenna also includes electronic components.

17. The vehicle according to claim 16, wherein the electronic components include a radio frequency (RF) front end, RF beam formers, RF up and down converters, a modem chip, analog filters, or power supply circuitry.

18. The vehicle according to claim 10, wherein the conformal antenna is a bowtie dipole antenna, a patch antenna, or a spiral antenna.

* * * * *